US005394941A

United States Patent [19]

Venditto et al.

[11] Patent Number: 5,394,941

[45] Date of Patent: Mar. 7, 1995

[54] FRACTURE ORIENTED COMPLETION TOOL SYSTEM

[75] Inventors: James J. Venditto, Duncan; Lee W. Stepp, Comanche; David D. Szarka, Duncan, all of Okla.

[73] Assignee: Halliburton Company, Duncan, Okla.

[21] Appl. No.: 80,610

[22] Filed: Jun. 21, 1993

[51] Int. Cl.[6] ..... E21B 34/06

[52] U.S. Cl. ..... 166/255; 166/376; 166/334

[58] Field of Search ..... 166/250, 255, 247, 376, 166/386, 332, 334

[56] References Cited

U.S. PATENT DOCUMENTS

| | | | |
|---|---|---|---|
| 2,414,997 | 1/1947 | Atkins | 285/97.3 |
| 3,653,435 | 4/1972 | Reistle, III et al. | 166/313 X |
| 4,523,649 | 6/1985 | Stout | 175/4.51 |
| 4,529,036 | 7/1985 | Daneshy et al. | 166/254 |
| 4,542,648 | 9/1985 | Vinegar et al. | 73/153 |
| 4,637,478 | 1/1987 | George | 175/4.51 |
| 4,673,890 | 6/1987 | Copland et al. | 33/178 F |
| 4,830,120 | 5/1989 | Stout | 175/4.51 |
| 4,926,940 | 5/1990 | Stromswold | 166/247 |
| 4,949,788 | 8/1990 | Szarka et al. | 166/285 |
| 4,979,561 | 12/1990 | Szarka | 166/240 |
| 4,991,654 | 2/1991 | Brandell et al. | 166/332 |
| 5,259,466 | 11/1993 | Venditto et al. | 166/55.1 X |

OTHER PUBLICATIONS

SPE 14272 entitled "Reservoir Rock Descriptions Using Computed Tomography (CT)" by M. M. Honarpour et al., Sep., 1985.

SPE 16952 entitled "Computed Tomography as a Core Analysis Tool: Applications and Artifact Reduction Techniques" by P. K. Hunt et al., Sep., 1987.

SPE 19408 entitled "Use of CT Scanning in the Investigation of Damage to Unconsolidated Cores" by R. E. Gilliland et al., Feb., 1990.

Paper entitled "X-Ray Computed Tomography for Carbonate Acidizing Studies" by F. Suzuki, Jun., 1990.

Brochure of Halliburton Logging Services, Inc., entitled "With HLS Technology", dated 1989.

Paper entitled "Field Performance of a New Borehole Televiewer Tool and Associated Image Processing Techniques" by D. Seiler et al., Jun., 1990.

Paper entitled "Geological and Borehole Features Described by the Circumferential Acoustic Scanning Tool" by Joseph F. Goetz et al.

Paper entitled "A New Approach to Determining Dip and Strike Using Borehole Images" by David Torres et al.

Brochure of Halliburton Logging Services, Inc., entitled "Telecast".

Paper entitled "An Introduction to the HLS Borehole Televiewer".

Paper entitled "Cast-The Circumferential Acoustic Scanning Tool".

Paper entitled "Modeling of the Stability of Highly Inclined Boreholes in Anisotropic Rock Formations" by Bernt S. Aadnoy (1987).

SPE/DOE 9836 entitled "Strain Relaxation Method for Predicting Hydraulic Fracture Azimuth from Oriented Core" by Lawrence W. Teufel, May, 1981.

(List continued on next page.)

[57] ABSTRACT

A fracture oriented completion tool system for use in a casing string in a wellbore. The completion tool comprises a casing valve having a radioactive source therein, the orientation of which may be determined by use of a detector apparatus, such as a rotational gamma ray detector. The casing valve thus may be aligned with the fracture of a zone of interest in the well. A plurality of casing valves may be used, with at least one having a radioactive source. A swivel connection may be used to interconnect the casing valve so that housing ports therein may be aligned as the casing is run into the wellbore. In one preferred embodiment, the swivel connection is a locking swivel connection. A method of positioning a casing string in the well utilizing the completion tool is also disclosed.

28 Claims, 5 Drawing Sheets

OTHER PUBLICATIONS

Paper entitled "Issues in Rock Mechanics" by Richard E. Goodman et al., Aug., 1982.

SPE/DOE 11624 entitled "The Relation Between Recovery Deformation and In-Situ Stress Magnitudes" by T. L. Blanton, Mar., 1983.

SPE 15072 entitled "Laboratory and Field Applications of the Strain Relaxation Method" by A. W. M. El Rabaa et al. (Apr., 1986).

Paper entitled "Determination of the Stress Field and Fracture Direction in the Danian Chalk" by W. El Rabaa.

Brochure of Halliburton Logging Services, Inc., entitled "Full Wave Sonic Log".

Paper entitled "The Determination of Fracture Orientation Using a Directional Gamma Ray Tool", by J. L. Taylor, III, Apr. 9, 1991.

Paper entitled "X-Ray CT and NMR Imaging of Rocks" by H. J. Vinegar.

SPE 13653 entitled "New Core Analysis Techniques for Naturally Fractured Reservoirs" by J. L. Bergosh et al., Mar., 1985.

*Primary Examiner*—Terry Lee Melius

*Attorney, Agent, or Firm*—Stephen R. Christian; Neal R. Kennedy

FRACTURE ORIENTED COMPLETION TOOL SYSTEM

BACKGROUND OF THE INVENTION

1. Field of The Invention

The present invention relates generally to completion tools for use in wellbores, and more particularly, to a completion tool which can be oriented to align ports therein with a plane of an existing downhole fracture or perpendicular to the least principal stress.

2. Brief Description Of The Prior Art

It is known that sliding sleeve type casing valves can be placed in the casing of a well to provide selective communication between the casing bore and subsurface formation adjacent to the casing valve. One such casing valve is shown in U.S. Pat. No. 4,991,654 to Brandell et al., assigned to the assignee of the present invention. The casing valve includes an outer housing with a sliding sleeve. First and second seals define a sealed annulus within the housing. A latch is disposed in the sealed annulus for latching the sliding valve in its first and second positions. The housing has a plurality of housing ports defined therein and the sliding sleeve has a plurality of sleeve ports defined therein. A third seal disposed between the sleeve and housing isolates all of the housing ports from all of the sleeve ports when the sleeve is in its first position relative to the housing. When the sleeve is moved to its second position relative to the housing, it is aligned so that the sleeve ports are in registry with the housing ports. A positioning tool, such as that disclosed in U.S. Pat. No. 4,979,561 to Szarka, also assigned to the assignee of the present invention, is used to position the sleeve in the casing valve. Once the sliding sleeve in the casing valve is moved to its second position, fluid may be jetted through the jetting tool as Szarka et al. disclosed in U.S. Pat. No. 5,029,644, assigned to the assignee of the present invention. The jetting tool is connected to a rotatable connection to the positioning tool.

Another casing valve assigned to the assignee of the present invention has a sliding sleeve with a selective latch profile, and a positioning tool has a corresponding latch profile so that the positioner block will latch only in the profile in the casing valve and not engage anything else in the casing string.

These prior casing valves have worked well, but when positioned may not be optimally aligned with an existing downhole fracture in the wellbore. Typically, these casing valves are currently run into the wellbore with four ports placed approximately 90° apart. The ports are placed adjacent to the zone of interest with no means of placing a port in the plane of the fracture. The resulting flow path between the port and fracture, when pumping a sand-laden fluid, may thus be quite circuitous and cause fracture tortuosity and possible screen-out of the fracture. Higher than necessary pump pressures may also be encountered in such situations.

The present invention solves this problem by providing a completion tool with a casing valve having an insert with a radioactive source or tracer therein which can be located with a rotational gamma ray sensor, such as in the HLS RotaScan tool. With prior knowledge of the plane of orientation of the fracture by use of existing logs or stress data, the casing string with the completion tool is rotated at the surface to orient the radioactive tracer insert as desired with the fracture. In this way, the completion ports can be relatively precisely aligned with the fracture to eliminate the interrupted flow path previously described.

SUMMARY OF THE INVENTION

The completion tool of the present invention is adapted for use in a casing string of a well. The apparatus comprises a casing valve. In one embodiment, at least two casing valves are interconnected, although any number of casing valves, including only one, may be used. Preferably, the first and second casing valves are interconnected by a swivel connection disposed between the casing valves. The swivel connection may be a locking swivel connection.

At least one of the first and second casing valves has a radioactive source disposed therein. In the preferred embodiment, this radioactive source is located in the lowermost casing valve. The radioactive source is aligned with a housing communication port in the corresponding casing valve, and this radioactive source may actually be disposed in the housing communication port.

The casing valve with the radioactive source may be described as a sliding sleeve casing tool apparatus comprising an outer housing having a longitudinal passageway defined therethrough and having a side wall with the housing communication port defined through the side wall, a sliding sleeve slidably disposed in the longitudinal passageway and being selectively movable relative to the housing between a first position blocking the housing communication port and a second position wherein the housing communication port is communicated with the longitudinal passageway, and the radioactive source in the form of a radioactive insert attached to the housing.

In one embodiment, the housing defines a hole aligned with the housing communication port, and the radioactive insert is disposed in the hole. A plug may be threadingly engaged with the hole for retaining the insert therein.

In another embodiment, the radioactive insert is disposed in the housing communication port, such as by threading engagement. In this latter embodiment, the radioactive insert may be made of a frangible material.

The housing communication port may be one of a plurality of such housing communication ports, and at least one radioactive insert is aligned with at least one of the housing communication ports.

The preferred swivel connection may be said to comprise a mandrel threadingly engaged with at least one of the casing valves, and a locking nut threadingly engaged with the mandrel for locking engagement with the corresponding casing valve, thus preventing relative rotation therebetween.

The present invention also includes a method of positioning a casing string in the well. The method comprises the steps of positioning a casing valve in the casing string, positioning a radioactive source on the casing valve, lowering the casing string into the well such that the casing valve is adjacent to a zone of interest, determining relative orientation of the radioactive source with respect to the zone of interest, and rotating the casing string as necessary to move a housing port in the casing valve into alignment with a fracture or direction of least principal stress of the zone of interest.

The step of positioning the radioactive source may comprise positioning the radioactive source in alignment with the housing port of the casing valve. In one embodiment, the step of positioning the radioactive source may comprise positioning the radioactive source in the housing port.

The step of determining relative orientation of the radioactive source may comprise positioning a radioactive detector means in the casing valve for responding to the radioactive source.

The method may further comprise the step of opening the housing port in the casing valve and pumping fluid through the housing port without substantial tortuosity.

Numerous objects, features and advantages of the present invention will become readily apparent to those skilled in the art upon a reading of the following disclosure when taken in conjunction with the accompanying drawings.

DESCRIPTION OF THE PREFERRED EMBODIMENT

Figure 1:
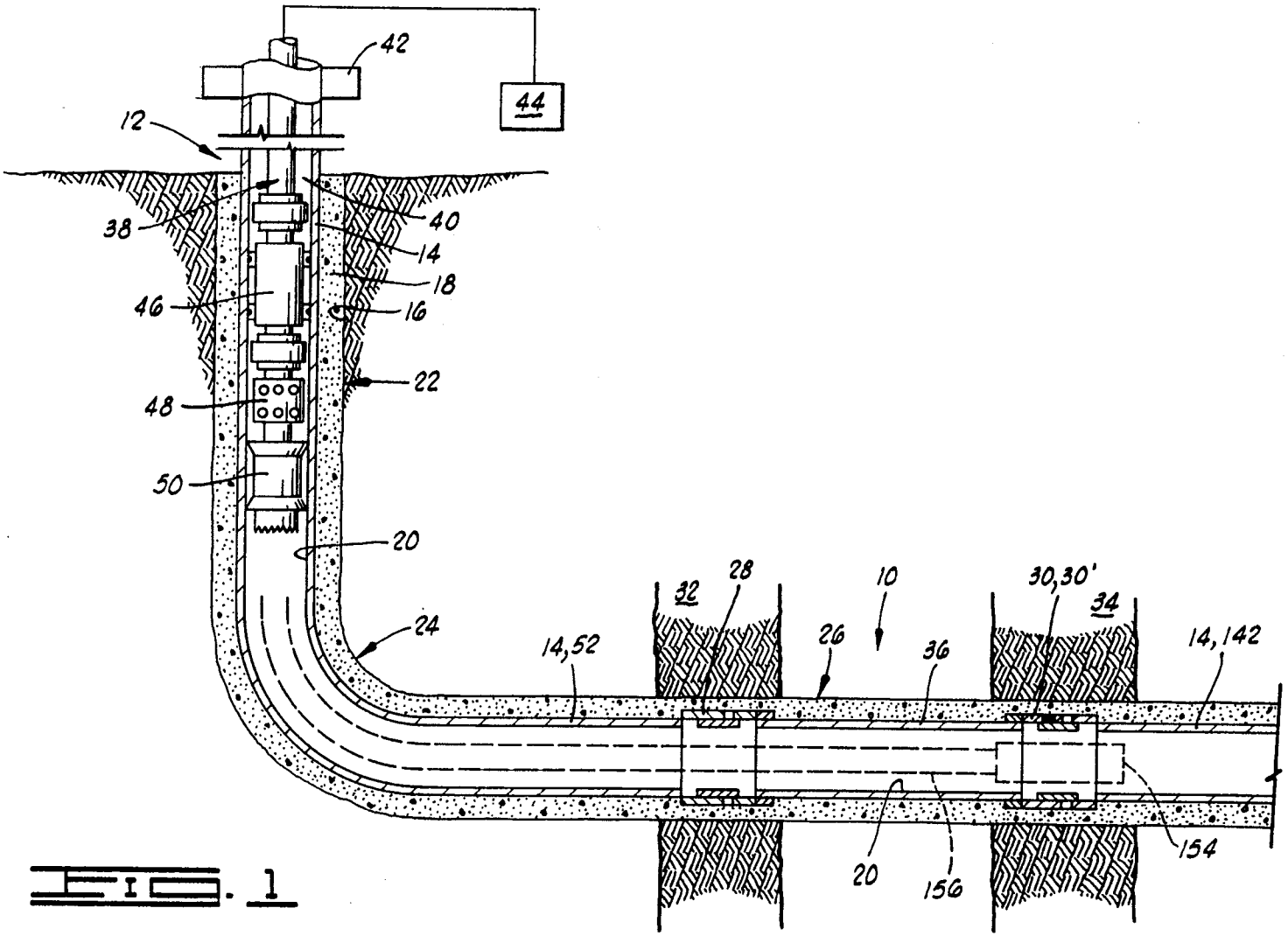
FIG. 1 is a schematic elevation sectioned view of a well having a substantially deviated well portion and with the completion tool of the present invention placed in the casing string.

Referring now to the drawings, and more particularly to FIG. 1, the full opening completion tool of the present invention is shown and generally designated by the numeral 10. Completion tool 10 is disposed in a well 12. Well 12 is constructed by placing a casing string 14 in a wellbore 16 and cementing the same in place with cement as indicated by numeral 18. Completion tool 10 forms a portion of casing string 14. Casing string 14 defines a casing bore 20 therethrough.

Well 12 has a substantially vertical portion 22, a radiused portion 24, and a substantially non-vertical deviated portion 26. In FIG. 1, deviated portion 26 is illustrated as being a substantially horizontal well portion 26, but the invention is not intended to be limited in such a well 14. Although the tools described herein are designed to be especially useful in the deviated portion of the well, they can, of course, also be used in the vertical portion of the well or in a wholly vertical well.

Completion tool 10 comprises a plurality of casing valves, such as a pair of casing valves 28 and 30, which are spaced along the deviated well portion 26 of well 14. Casing valves 28 and 30 are located adjacent to a subsurface zone or formation of interest, such as zones 32 and 34, respectively. It should be understood that the invention is not intended to be limited to only a pair of casing valves, and any number of casing valves may be used and-positioned adjacent to any number of zones.

In a preferred embodiment, casing valves 28 and 30 are interconnected by a locking swivel connection 36. However, a more conventional, non-locking swivel connection may also be used. Also, casing valves 28 and 30 may also be interconnected by a normal casing joint or joints.

In FIG. 1, a tubing string 38 having a plurality of tools connected to the lower end thereof is shown as being lowered into well casing 14. As will be further discussed, tubing string 38 and the tools therein are used in conjunction with completion tool 10.

A well annulus 40 is defined between tubing string 38 and casing string 14. A blowout preventer 42 located at the surface is provided to close well annulus 40. A pump 44 is connected to tubing string 38 for pumping fluid down tubing string 38.

Tubing string 38 shown in FIG. 1 has a positioner tool apparatus 46, a jetting tool apparatus 48, and may also have a wash tool apparatus 50 connected thereto.

Referring now to FIGS. 2A–2F, the details of one embodiment of completion tool 10 will be discussed.

Completion tool 10 is connected to an upper portion 52 of casing string 14. In the illustrated embodiment, casing valve 28 of completion tool 10, shown in FIGS. 2A–2C, comprises an upper body 54 which forms a threaded connection 56 with upper portion 52 of casing string 14. Upper body 54 is attached to the upper end of an outer housing or case 58. Housing 58 defines a longitudinal passageway 60 therethrough and has a side wall 62 with a plurality of housing communication ports 64 defined through the side wall. Preferably, but not by way of limitation, there are two ports 64 spaced 180° apart.

A lower body 66 is attached to the lower end of housing 50. Lower body 66 has an internal straight thread 68 for connection to locking swivel connection 36 as will be further described herein.

Casing valve 28 also comprises a sliding sleeve 70 which includes a collet sleeve 72 attached to a seal sleeve 74 at threaded connection 76. Sleeve 70 is disposed in longitudinal passageway 60 of housing 58 and is selectively movable relative to housing 58 between a first position shown in FIGS. 2A–2C blocking or covering housing communication ports 64 and a second position wherein housing communication ports 64 are uncovered and are communicated with longitudinal passageway 60.

Casing valve 28 also includes an upper wiper 78 which provides wiping engagement between collet sleeve 72 and housing 58. Casing valve 28 further includes spaced lower seals 80 and 82 which provide sealing engagement between seal sleeve 74 and housing 58. In the first position of sleeve 70, it will be seen that seals 80 and 82 are on longitudinally opposite sides of housing communication ports 64, thus sealingly separating ports 64 from longitudinal passageway 60.

A position latching means 84 is provided for releasably latching sliding sleeve 70 in its first and second positions. Position latching means 84 is disposed in an annulus 86 defined between sliding sleeve 70 and housing 58. It will be seen that annulus 86 is protected between upper wiper 78 and seal 80.

Position latching means 84 includes a spring collet 88, which may also be referred to as a spring biased latching means 88. Spring collet 88 is longitudinally positioned between upper end 90 of seal sleeve 74 of sliding sleeve 70 and downwardly facing shoulder 92 on collet sleeve 72 of sliding sleeve 70. Thus, collet 88 moves longitudinally with sliding sleeve 70 and may be considered to be attached thereto.

Position latching means 84 also includes first and second radially inwardly facing, longitudinally spaced grooves 94 and 96 defined in housing 58 and corresponding to first and second positions, relatively, of sliding sleeve 70.

By placing spring collet 88 in annulus 86, the collet is protected in that cement, sand and the like are prevented from packing around the collet and impeding its successful operation.

It is noted that position latching means 84 could also be constructed by providing a spring latch attached to housing 58 and providing first and second grooves in sliding sleeve 70 rather than vice versa as they have been illustrated.

Figure 2A:
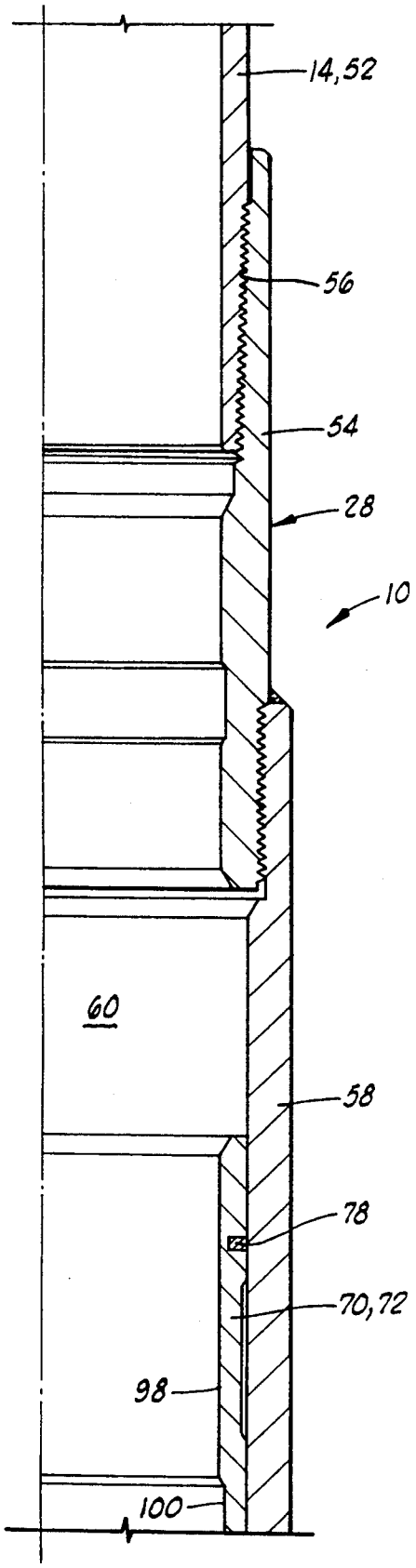
FIGS. 2A–2F show a cross-sectional view of the completion tool of the present invention.
Figure 2B:
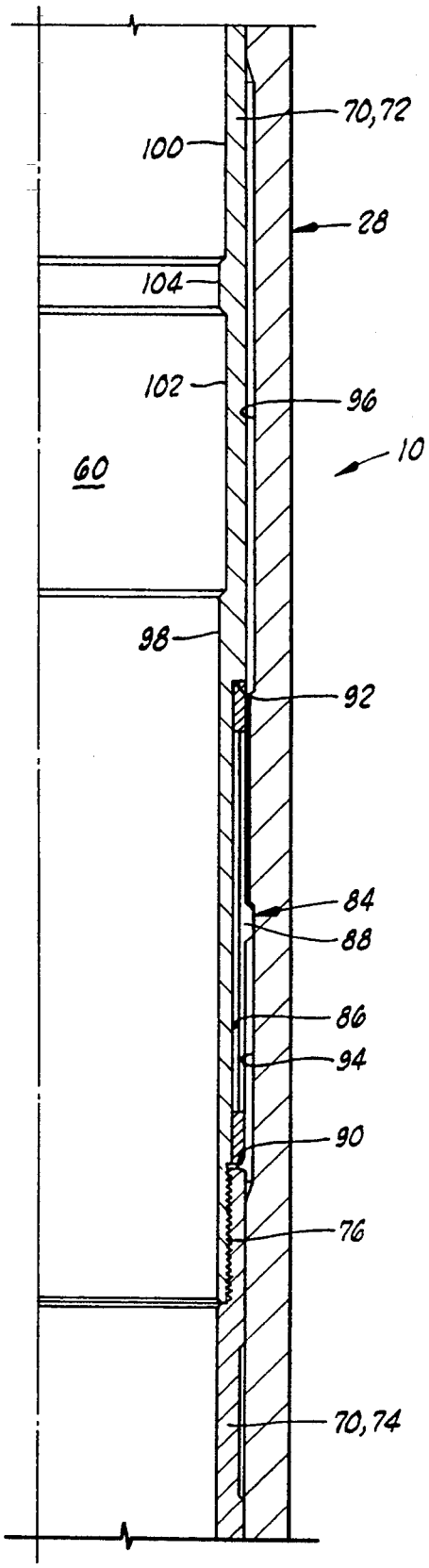

Sliding sleeve 70 has a longitudinal sleeve bore 98 defined therethrough. Collet sleeve 72 of sliding sleeve 70 defines first and second inwardly facing grooves 100 and 102 therein, as best seen in FIGS. 2A and 2B. Thus, it may be said that first groove 100 and second groove 102 are separated by a ring or shoulder portion 104. First and second grooves 100 and 102 and ring 104 therebetween form a latch profile adapted for engagement by positioning tool 46 in a manner such as described in co-pending U.S. patent application Ser. No. 07/781,701, a copy of which is incorporated herein by reference.

Sliding sleeve 70 has a lower end 106 which is the lower end of seal sleeve 74. In the illustrated embodiment, end 106 is positioned adjacent to lower body 66 and below housing communication port 64 when sliding sleeve 70 is in the first position shown.

Figure 2C:
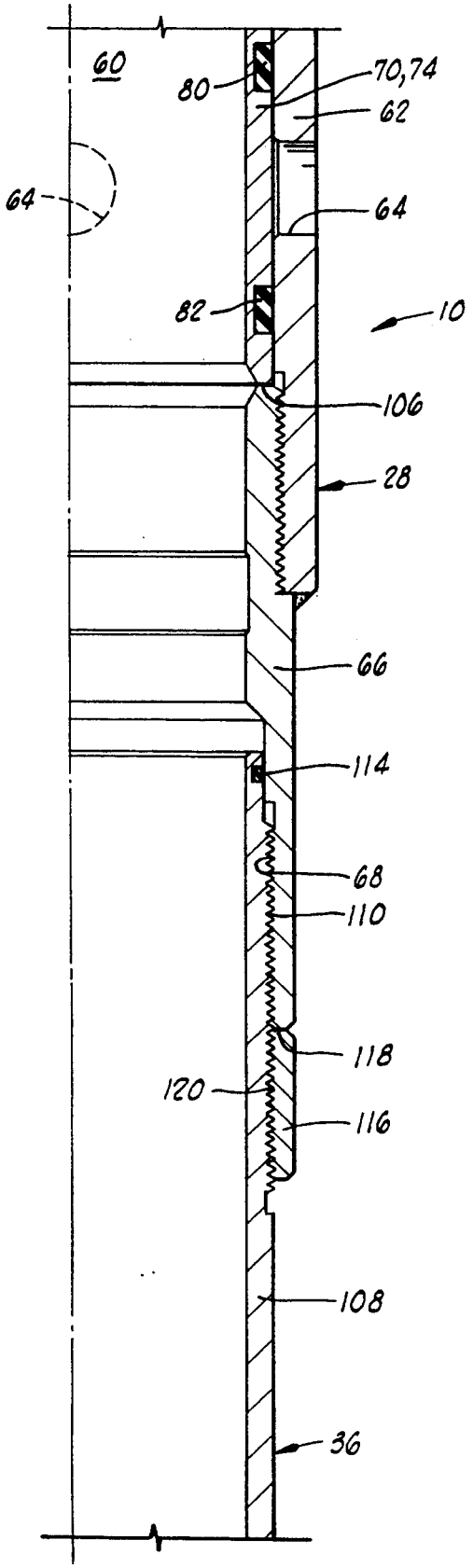
Figure 2D:
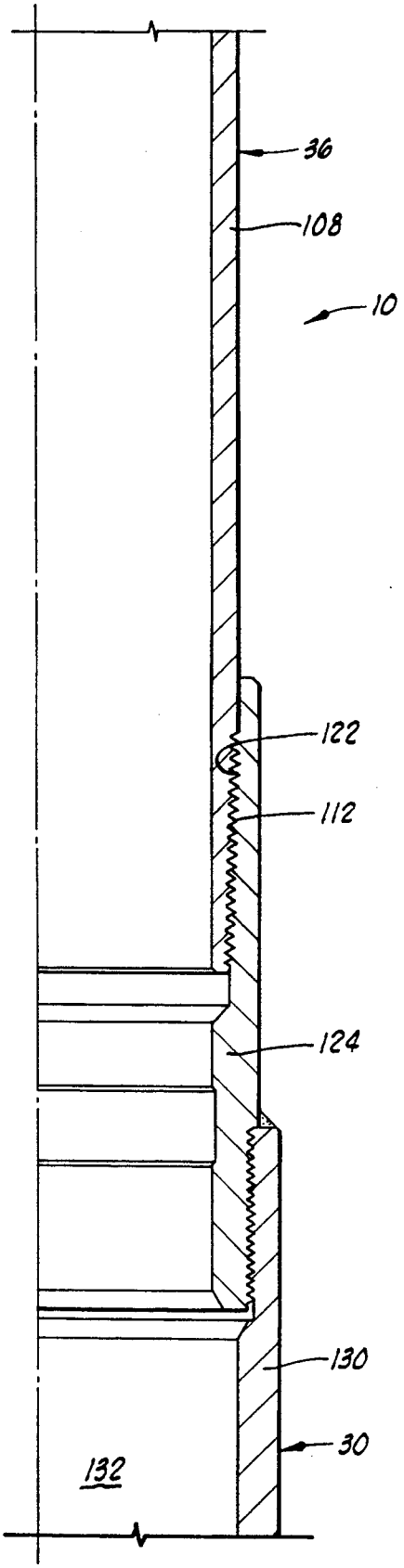
Figure 2E:
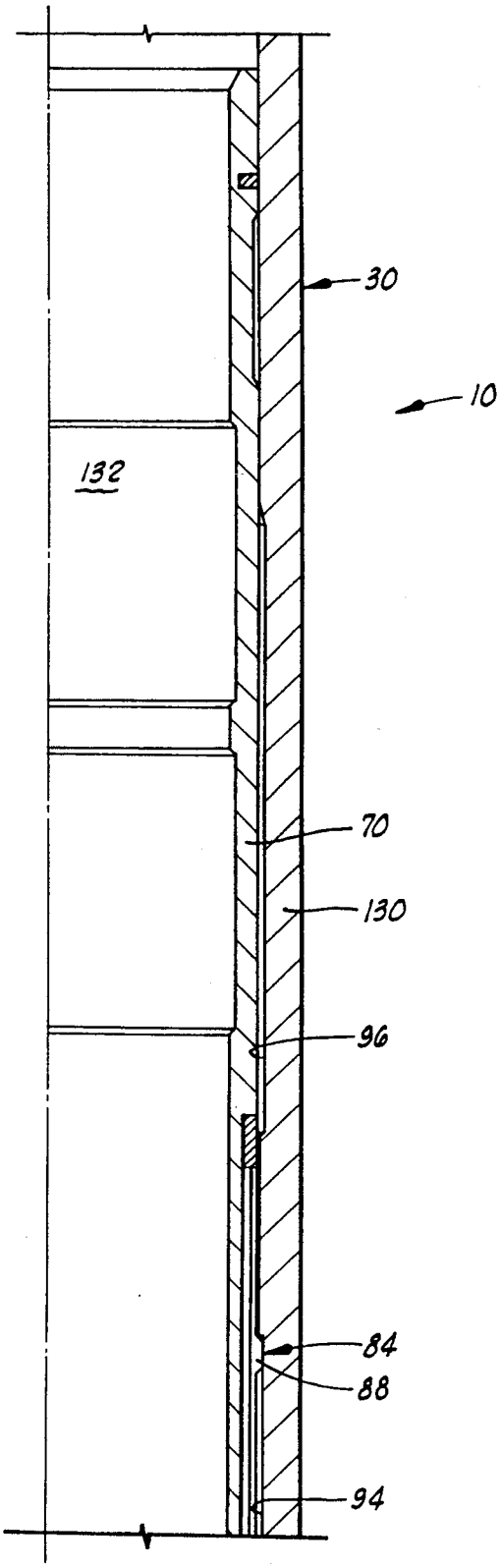

Referring now to FIGS. 2C and 2D, locking swivel connection 36 will be described. Swivel 36 comprises a casing pup joint or mandrel 108 having an external straight thread 110 and an external tapered thread 112 at the upper and lower ends thereof, respectively. Straight thread 110 is engaged with thread 68 in lower body 66 of casing valve 28. A sealing means, such as seal 114, provides sealing engagement between pup joint 108 and lower body 66.

A locking nut 116 is positioned around pup joint 108 and adjacent to lower end 118 of lower body 66 of casing valve 28. Locking nut 116 has an internal straight thread 120 which is also threadingly engaged with external thread 110 on pup joint 108.

The lower end of pup joint 108 is connected to casing valve 30 by the threaded engagement of external tapered thread 112 with internal tapered thread 122 in an upper body 124 of casing valve 30.

While pup joint 108 is shown as being directly connected to lower casing valve 30, it should be understood that the pup joint may be connected to the lower casing valve by one or more casing collars. That is, upper and lower casing valves 28 and 30 may be separated by one or more casing joints.

Similar to casing valve 28, upper body 124 of casing valve 30 is attached to an outer housing or case 130. Housing 130 has a longitudinal passageway 132 defined therethrough and a side wall 134 with a plurality of housing communication ports 136 defined through the side wall. See FIGS. 2D–2F.

A lower body 138 is attached to the lower end of housing 130. Lower body 138 has an external thread 140 for connection to a lower portion 142 of casing string 14.

Figure 2F:
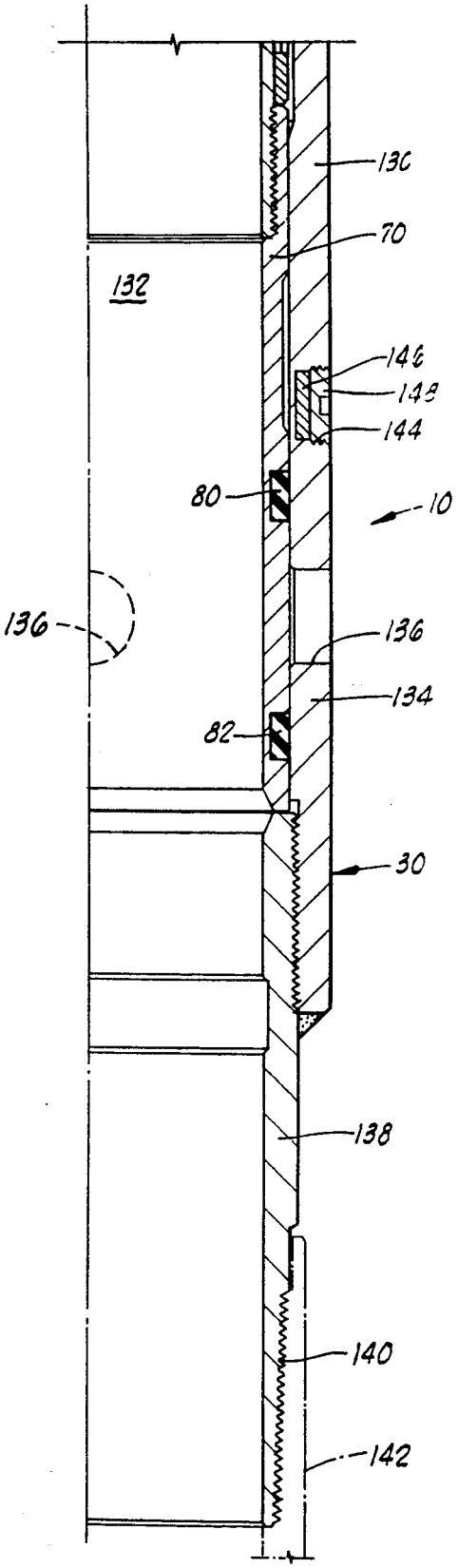

Outer housing 130 of casing valve 30 is almost identical to outer housing 58 of casing valve 28, except that housing 130 also has at least one threaded hole 144 defined therein, as seen in FIG. 2F. Hole 144 is aligned in an axial direction with one of housing communication ports 136.

A radioactive insert 146 is disposed in threaded hole 144 and held in place by a threaded plug 148. The material from which insert 146 is made provides a radioactive tracer or source used to position casing valve 30, and thus completion tool 10, as will be further described herein.

The internal components of casing valve 30 are substantially identical to those of casing valve 28. That is, casing valve 30 also includes a sliding sleeve 70 with seals 80 and 82 thereon and a position latching means 84.

Alternate Embodiment

Figure 3:
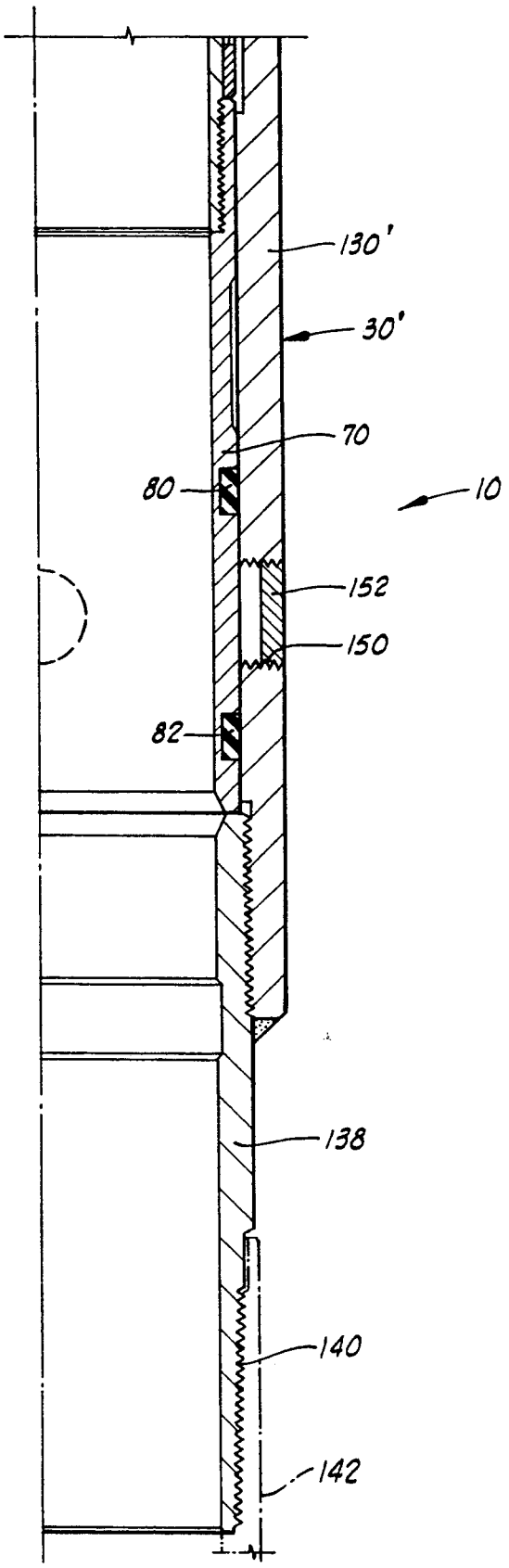
FIG. 3 shows a lower portion of an alternate embodiment of the completion tool of the present invention.

Referring now to FIG. 3, the lower end of an alternate lower casing valve 30' is shown. Casing 30' has an outer housing or case 130' defining a plurality of housing communication ports 150 therein. At least one of housing communication ports 150 is threaded in a threaded radioactive insert 152 and is installed in the threaded housing communication port 150 and thus is aligned with the port. In one preferred embodiment, threaded radioactive insert 152 is made of a frangible material which will fracture readily when subjected to fluid discharged from a jetting tool, as further described herein.

Operation Of The Invention

Completion tool 10 preferably is made up so that housing communication ports 64 in casing valve 28 are aligned in an axial direction with housing communication ports 136 of casing valve 30 or housing communication ports 150 of casing valve 30'. That is, each housing communication port 64 is longitudinally aligned with a corresponding housing communication port 136 or 150.

Completion tool 10 may be made up in a conventional manner with a normal casing joint between casing valves 28 and 30. In this instance, ports 64 are substantially aligned with ports 136 or 150 by varying the torque applied to the tool during assembly. However, it is possible that in this technique the ports will not be truly aligned in some cases, such as with premium connections which make up against a set shoulder. Better alignment may be possible by use of a swivel connection between casing joints 28 and 30. For example, alignment is accomplished through the use of locking swivel connection 36 in which pup joint 108 is threaded into lower body 66 of casing valve 28 and into upper body 124 of casing valve 30 or 30'. Because of the straight threads, the casing valves may be rotated easily with respect to pup joint 108 to align the housing communication ports. When the ports are aligned, locking nut 116 is threaded upwardly on external thread 110 of lower body 66 of casing valve 128 until the locking nut lockingly jams against lower end 118 of lower body 66, thereby preventing further relative rotation between casing valve 28 and pup joint 108.

Completion tool 10 as part of casing string 14 is run into borehole 16 in a conventional manner until the casing valves are positioned adjacent to the zones of interest, such as zones 32 and 34 shown in FIG. 1.

A radioactive detection means, such as a rotational gamma ray detector apparatus 154, may be run down into casing 14 by any means, such as a tubing string 156. One such gamma ray detector is the Halliburton HLS RotaScan tool, but the invention is not intended to be limited to this particular device. Detector apparatus 154 is used to determine the position of radioactive insert 146 or 152, and thus the orientation of casing valve 30 and completion tool 10.

By prior knowledge of the plane of orientation of the fracture by use of existing well logs, or stress data, casing string 114 may be rotated at the surface to orient radioactive insert 146 (or 152) with the fracture. It will thus be seen that housing communication ports 64 and 136 (or 150) are thereby aligned with the fracture as well.

After completion tool 10 (or 10') with casing valves 28 and 30 (or 30'), is positioned as desired, it may be cemented in place as shown in FIG. 1. However, it should be understood that the invention is not necessarily limited to a casing string 14 which is cemented in place. Completion tool 10 may also be used in uncemented completions wherein zonal isolation between the casing valves is established by external casing packers or the like. Also, the casing valves may be used in any cemented/uncemented combination.

After cementing of casing string 14, the next trip into the well is with tubing string 38 including positioner tool 46, jetting tool 48 and wash tool 50, as schematically illustrated in FIG. 1. In FIG. 1, this tool assembly is shown as it is being lowered into vertical portion 22 of well 12. The tool assembly will pass through radiused portion 24 and into non-vertical portion 26 of well 12. The tool assembly should first be run to just below lowermost casing valve 30 (or 30').

Then, hydraulic jetting begins, utilizing a filtered clear completion fluid. Hydraulic jetting is performed with jetting tool 48 by pumping fluid down tubing string 38 and out the jetting nozzles in the jetting tool to impinge casing bore 20. Jetting tool 48 is moved upwardly through casing valve 30 or 30' to remove any residual cement from all of the recesses in the internal portion of casing valve 30 or 30'. This is particularly important when casing valve 30 or 30' is located in a deviated well portion because significant amounts of cement may be present along the lower inside surfaces of the casing valve. The cement must be removed to insure proper engagement of positioning tool 46 with sleeve 70.

It is noted that when the terms "upward" or "downward" are used in the context of direction of movement in the well, these terms are used to mean movement along the axis of the well either uphole or downhole, respectively, which in many cases may not be exactly vertical and can in fact be horizontal in a horizontally oriented portion of the well.

After hydraulically jetting the internal portion of casing valve 30 or 30', positioning tool 46 is lowered back through casing valve 30 or 30' and used to engage and actuate sliding sleeve 70 therein in a manner known in the art. Tubing string 38 is pulled upwardly to apply an upward force to sliding sleeve 70 of casing valve 30 or 30'. Spring collet 88 is initially in engagement with first groove 94 of housing 130 or 130', and the upward pull will compress the collet to release first groove 94. As collet 88 compresses and releases, a decrease in upward force will be noted at the surface to evidence the beginning of the opening sequence. Sliding sleeve 70 will continue to be pulled to its full extent of travel which can be confirmed by sudden rise in weight indicator reading at the surface as the top of sliding sleeve 70 abuts upper body 124. At this point, collet 88 will engage second groove 96.

Jetting of communication ports 136 or 150 may then be carried out using jetting tool 48 in a manner known in the art. With first embodiment casing valve 30, the jetted fluid is discharged directly through housing communication ports 136 to remove any cement therefrom. With second embodiment casing valve 30', using a frangible radioactive insert 152, jetting will fracture the insert in housing communication port 150, thereby opening housing communication port 150 and cleaning it out.

In still another embodiment, radioactive insert 152 is not necessarily made of a frangible material. In such a case, at least one communication port 150 in housing 130' does not have an insert 152 therein. After alignment of the radioactive insert with the fracture using detection apparatus 154, as previously described, casing 14 is rotated by the angular displacement between ports 150. That is, if ports 150 are spaced 90° apart, casing string 14 is rotated 90° so that an unplugged housing communication port 150 is aligned with the fracture. After opening of casing valve 30', jetting is substantially identical to that previously described.

Once jetting of casing valve 30 or 30' has been completed, positioning tool 46 is used to close sleeve 70. If desired, blowout preventer 40 can be closed and the casing can be pressure tested to confirm that casing valve 30 or 30' is in fact closed.

Then, the tubing string 38 is moved upwardly to casing valve 28, and the sequence is repeated. The only difference between casing valve 28 and casing valve 30 or 30' is that casing valve 28 does not have a radioactive insert. Again, although only two casing valves 28 and 30 (or 30') are shown in FIG. 1, additional casing valves may be included in casing string 14.

Once all of the casing valves have been jetted out and reclosed, the work string may be pulled to the top of the liner, or to the top of non-vertical portion 26 of casing 14 and backwashed. Backwashing is accomplished in a manner known in the art using wash tool 50.

The jetting operation is used to remove cement from and adjacent to the communication ports in the casing valves for facilitating fracture initiation by easing access to the formation. In the actual fracturing operation, a mechanical positioning tool is run into the casing with a packer positioned thereabove. The mechanical positioning tool may be used to open and close the sleeves in the casing valves so that sand-laden fluid may be pumped through the communication ports into the well formation. Since the casing valves have been oriented with the fracture as previously described, there is no significant interruption in the flow path between the housing communication ports (136 in casing valve 30, 150 in casing valve 30', or 64 in casing valve 28) and the fracture when pumping the sand-laden fluid. This eliminates fracture tortuosity and possible screen-out and keeps pump pressures at a minimum.

It will thus be seen that the present invention is well adapted to achieve the ends and advantages mentioned, as well as those inherent therein. While certain preferred embodiments of the invention have been illustrated and described for the purposes of this disclosure, numerous changes in the arrangement and construction of parts may be made by those skilled in the art. All such changes are encompassed within the scope and spirit of the appended claims.

What is claimed is:

1. A sliding sleeve casing tool apparatus for use in a casing string of a well, said apparatus comprising:

an outer housing having a longitudinal passageway defined therethrough and having a side wall with a housing communication port defined through said side wall;

a sliding sleeve slidably disposed in said longitudinal passageway and being selectively movable relative to said housing between a first position blocking said communication port and a second position wherein said communication port is communicated with said longitudinal passageway; and a radioactive insert attached to said housing in a predetermined relationship to said housing communication port, whereby a relative orientation of said outer housing within the well may be determined.

2. The apparatus of claim 1 wherein:

said housing defines a hole aligned with said housing communication port; and said radioactive insert is disposed in said hole.

3. The apparatus of claim 2 further comprising a plug threadingly engaged with said hole for retaining said insert therein.

4. The apparatus of claim 1 wherein said radioactive insert is disposed in said housing communication port.

5. The apparatus of claim 4 wherein said radioactive insert is threadingly engaged with said housing communication port.

6. The apparatus of claim 4 wherein said radioactive insert is made of a frangible material.

7. The apparatus of claim 1 wherein:

said housing communication port is one of a plurality of housing communication ports; and said radioactive insert is aligned with at least one of said housing communication ports.

8. A completion tool apparatus for use in a casing string of a well, said apparatus comprising:

a first casing valve;

a second casing valve; and a swivel connection disposed between said first and second casing valves, whereby said first and second casing valves may be placed in a predetermined relative orientation prior to installation of the casing string in the well.

9. The apparatus of claim 8 wherein said swivel connection is a locking swivel connection.

10. The apparatus of claim 8 wherein at least one of said first and second casing valves has a radioactive source disposed therein whereby a relative orientation of said one of said first and second casing valves with respect to the well may be determined.

11. The apparatus of claim 10 wherein said radioactive source is disposed in a lowermost casing valve.

12. The apparatus of claim 10 wherein said radioactive source is aligned with a housing port in said one of said casing valves.

13. The apparatus of claim 12 wherein said radioactive source is disposed in said housing port.

14. A method of positioning a casing string in a well, said method comprising the steps of:

positioning a casing valve in said casing string;

positioning a radioactive source on said casing valve;

lowering said casing string into the well such that said casing valve is adjacent to a zone of interest;

determining relative orientation of said radioactive source with respect to said zone of interest; and rotating said casing string as necessary to move a housing port in the casing valve into alignment with a fracture of said zone of interest.

15. The method of claim 14 wherein said step of positioning said radioactive source comprises positioning said radioactive source in alignment with said housing port of said casing valve, 16. The method of claim 15 wherein said step of positioning said radioactive source comprises positioning said radioactive source in said housing port.

17. The method of claim 14 wherein said step of determining relative orientation comprises positioning a radioactive detector means in said casing valve for responding to said radioactive source.

18. The method of claim 14 further comprising the step of opening said housing port in said casing valve and pumping fluid through said housing port without substantial tortuosity.

19. A completion tool apparatus for use in a casing string of a well, said apparatus comprising:

a first casing valve;

a second casing valve; and a locking swivel connection disposed between said first and second casing valves, said locking swivel connection comprising a locking nut adapted for locking engagement with at least one of said casing valves, thereby preventing relative rotation between the casing valves.

20. The apparatus of claim 19 wherein at least one of said first and second casing valves has a radioactive source disposed therein, whereby a relative orientation of said one of said first and second casing valves with respect to the well may be determined.

21. The apparatus of claim 20 wherein said radioactive source is disposed in a lowermost casing valve.

22. The apparatus of claim 20 wherein said radioactive source is aligned with a housing port in said one of said casing valves.

23. The apparatus of claim 22 wherein said radioactive source is disposed in said housing port.

24. A completion tool apparatus for use in a casing string of a well, said apparatus comprising:

a first casing valve;

a second casing valve; and a locking swivel connection disposed between said first and second casing valves, said locking swivel connection comprising:

a mandrel engaged with one of said first and second casing valves by a straight thread connection and also connected to the other of said first and second casing valves; and a locking nut engaged with said mandrel for locking against said one of said first and second casing valves, thereby preventing relative rotation between said casing valves.

25. The apparatus of claim 24 wherein at least one of said first and second casing valves has a radioactive source disposed therein, whereby a relative orientation of said one of said first and second casing valves with respect to the well may be determined.

26. The apparatus of claim 25 wherein said radioactive source is disposed in a lowermost casing valve.

27. The apparatus of claim 25 wherein said radioactive source is aligned with a housing port in said one of said casing valves.

28. The apparatus of claim 27 wherein said radioactive source is disposed in said housing port.

* * * * *